United States Patent [19]

Erzen et al.

[11] 4,018,057

[45] Apr. 19, 1977

[54] OFF SHORE STRUCTURES

[75] Inventors: Cevdet Erzen, The Hague, Netherlands; Robert Tillyer, Maidstone; Norman Elliott Williams, Billingham, both of England

[73] Assignee: King-Wilkinson, Limited, London, England

[22] Filed: May 28, 1974

[21] Appl. No.: 473,930

[30] Foreign Application Priority Data

June 1, 1973 United Kingdom ..... 26347/73

[52] U.S. Cl. ..... 61/88; 52/638; 61/87

[51] Int. Cl.[2] ..... E02B 17/00; F02D 23/02

[58] Field of Search ..... 61/46.5, 46; 114/.5 R, 114/.5 D; 52/637, 638; 248/235; 182/178

[56] References Cited

UNITED STATES PATENTS

| | | | |
|---|---|---|---|
| 2,352,370 | 6/1944 | Carruthers | 61/46.5 |
| 3,186,180 | 6/1965 | Swanlund et al. | 61/46.5 |
| 3,347,052 | 10/1967 | Steitle et al. | 61/46.5 |
| 3,381,481 | 5/1968 | Chamberlin et al. | 61/46.5 |
| 3,402,557 | 9/1968 | Steele | 61/46.5 |
| 3,570,259 | 3/1971 | Thaxton | 61/46.5 X |
| 3,572,041 | 3/1971 | Graaf | 61/46.5 |
| 3,611,734 | 10/1971 | Mott | 61/46.5 |
| 3,641,774 | 2/1972 | Hekkanen et al. | 61/46.5 |
| 3,729,940 | 5/1973 | Koehler | 61/45.5 |
| 3,783,626 | 1/1974 | Hansen | 61/46.5 |
| 3,815,371 | 6/1974 | Koehler | 61/46.5 |
| 3,823;564 | 7/1974 | Crout et al. | 61/46.5 |
| 3,824,795 | 7/1974 | Mo | 61/46.5 |
| 3,852,969 | 12/1974 | Gibson et al. | 61/46.5 |

FOREIGN PATENTS OR APPLICATIONS

| | | | |
|---|---|---|---|
| 1,444,839 | 5/1966 | France | 61/46.5 |

*Primary Examiner*—Dennis L. Taylor
*Attorney, Agent, or Firm*—Pennie & Edmonds

[57] ABSTRACT

An offshore tower structure has a polygonal hollow base which can be selectively flooded or made buoyant, at least five columns sloping upwards and inwardly from apices of the base to a top frame above the surface of the water and bracing members arranged in zig-zag patterns between each pair of adjacent columns.

8 Claims, 30 Drawing Figures

Figure 1:
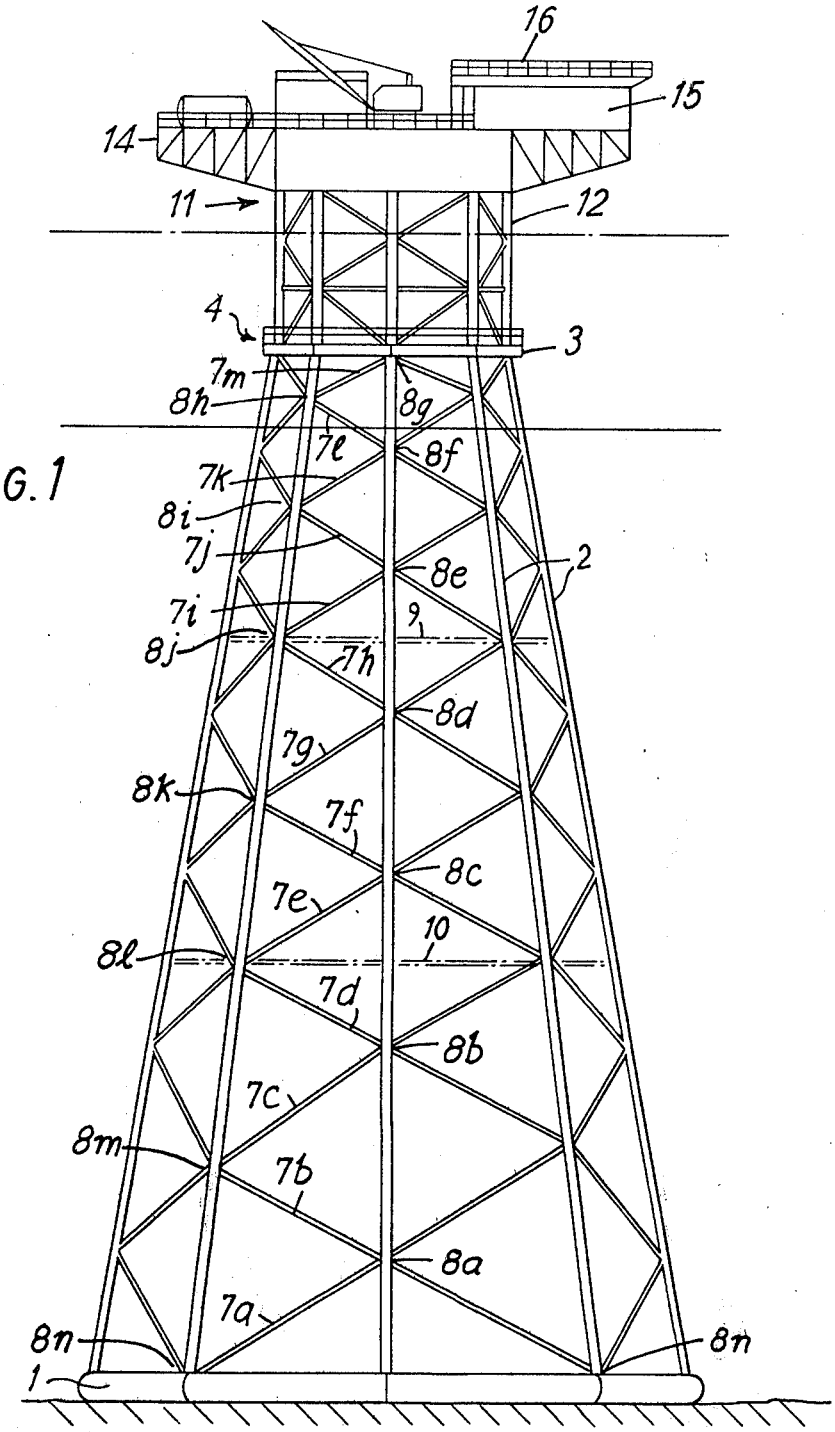

FIG. 19.
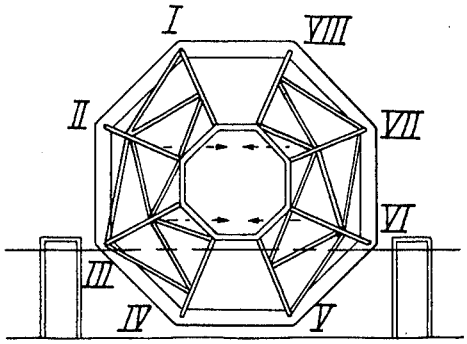
FIG. 20.
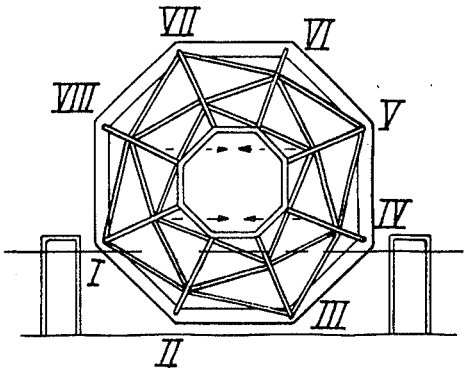
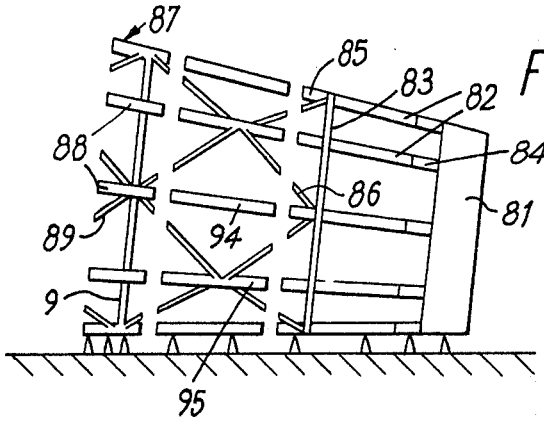
FIG. 21

OFF SHORE STRUCTURES

This invention relates to off shore structures in the form of a tower which in use has its base on the bed beneath a body of water. Such towers may for example carry a platform above the surface of the water (and above any likely wave action) for supporting exploration and/or production facilities for oil and/or gas.

According to the present invention, there is provided a tower structure which in use is supported on the bed beneath a body of water, the structure comprising at least five columns each sloping downwards and outwards from a braced top frame of the tower to a polygonal annular base member, the structure having bracing between each pair of adjacent columns.

Such a tower structure is effectively an open latticework truncated pyramid which is broadest at its base, thereby providing stability against overturning by wave action, and narrowing towards its upper end, thereby presenting a reduced surface area to lateral wave action near the surface, where the lateral forces exerted by the wave action are greatest.

Furthermore, the more regularly distributed larger number of columns, as compared with previous proposals, spaced around the circumference of the tower structure ensures that its ability to withstand lateral forces is practically uniform in all directions. The base member enables the loads transmitted by the columns to be spread over a considerable area. The tower structure can accommodate local failure in the supporting bed or failure of a pile extending from one of the columns into the bed.

This tower may be built with columns extending from the bottom to the top deck of the hull in a continuous straight manner or the tower may be stoped at a certain elevation above or below sea level and a superstructure may be placed on top of the tower.

Preferably, the bracing members constituting the said bracing between adjacent columns do not intersect each other between the columns and are arranged in a zig-zag formation with the junctions of the braces on opposite sides of each column being in register.

Advantageously the base member is constructed to form one or more floodable buoyancy chambers. The tower structure may then be assembled on its side, usually from prefabricated units, on support rails or on a slipway or in a graving dock. It can then be launched or floated out and towed into deeper water, to its intended site, or it can be supported on a barge for towing to its intended site where it is launched and floated. It is then uprighted by controlled flooding of the base member. Further flooding of the base member chamber or chambers causes the structure to settle into position on the underwater bed.

In an alternative method of construction, the base of the tower is constructed in its upright attitude and floated into deep sheltered water, and progressively lowered in the water by partial flooding as successive upper sections are added.

A crude oil storage reservoir, for example, of steel or reinforced concrete may be provided on the bottom within the tower structure.

It is preferred to construct the columns and bracing in the form of tubing. The hollow interior of the columns and bracing can provide buoyancy to assist in floating the structure and manoeuvring into position, while the hollow columns can act a guides for piles driven into the sea bed by a pile driver temporarily mounted on top of the tower structure.

Advantageously, the bracing between each pair of adjacent columns is arranged so that at any junction of braces with a column, two and only two braces in the same plane through the column intersect that column in the position of the junction. This ensures that with simple butt joints between the braces and the column, the axis of each brace, especially where the braces and columns are tubular, can intersect the axis of the column, thereby eliminating any moments tending to distort and fatigue the joints. One brace at each junction may be inclined above the horizontal while the other is inclined below the horizontal.

By arranging that the brace-to-column junctions associated with the columns on each side of any column coincide, the braces will extend upwards around the structure substantially in two sets of frusto-conical helices of opposite hand, having the same constant angle to the horizontal in the case of a structure having an even number of regularly spaced columns.

Stability against overturning due to waves can be achieved by suitably filling the base after placing it on the sea bottom as a base to support the entire structure. Examples of suitable filling materials are water, crude oil replaceable by water, concrete, and granular material such as sand which may be in the form of a slurry. In addition, the base member can be provided with nozzles supplied by high pressure pipes connected to pumps placed on the top of the tower on the superstructure. By manipulating the supply to the nozzles the sand under the base member may be jetted away so as to provide a flat horizontal base before driving the piles.

In addition, auxiliary piles can be provided along the lower part of each column. The auxiliary piles may pass through a jacket or sleeve which consists of two parts, namely, a fixed lower sleeve part and a removable upper part. The end of the removable sleeve part is fitted to the top of the fixed sleeve part by means of a collar. In addition, the removable sleeve is connected to the main column above the surface of the water. After driving the auxiliary piles, and grouting them to the fixed sleeves, the connections on the removable sleeves are severed and the upper sleeves are pulled away.

The auxiliary sleeves are connected to the main sleeves by means of bracket plates. The pair of bracket plates at each connecting point are stiffened laterally by means of stiffener plates. In the event that the piles must be removed, the bracket plates are burned off in order to detach them completely from the main structure.

It is conceivable that the structure may be used without the assistance of piles provided the foundations on which the base member sits has high bearing capacity, such as sand, and that the scour under the base member may be curtailed. In the event the structure is to be used without piles, overturning of the structure due to wave and wind forces may be overcome by means of the weight provided by filling the base member and if desired the entire or some portion of the columns with heavy material such as concrete or a granular material conducted into the member or members through a pipe. For additional strength, reinforcing bars may be used with concrete. In such an event, since weight is important, all the brace members can be filled with water by opening valves mounted on these members or, if necessary, with concrete.

The scour under the base member may be eliminated by attaching wing means which modifies the streamlines of the flow around the base. Due to the change of streamlines the velocity of the flow is also modified to the level whereby the water particles cannot carry the sand upward over the base, but can only deposit it under the wing means, rendering it more useful as a load supporting element of the structure. Thus, the wing means function not only to eliminate the scour but also to support greater loads without causing excessive settlement.

An open space may be provided between the wing means and the face of the base member to further modify the streamlines to help reduce the scour.

Figure 2:
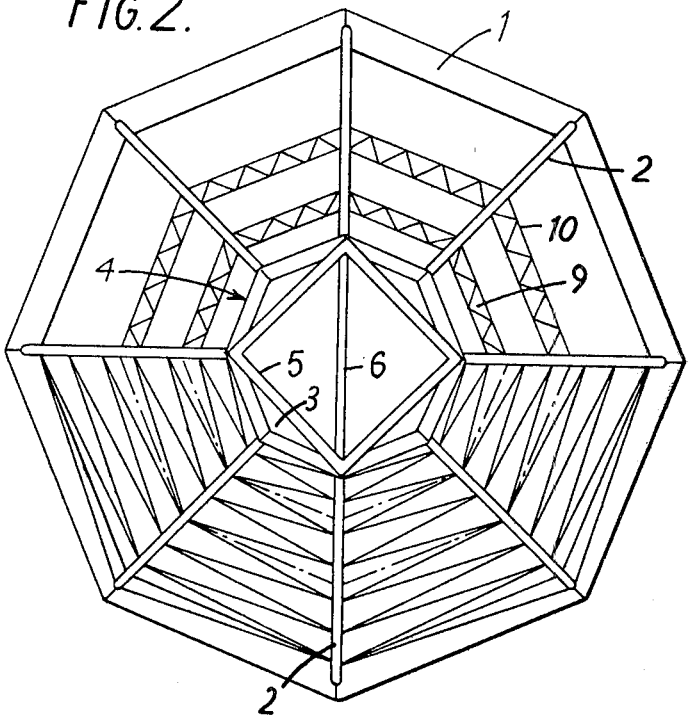
Figure 4:
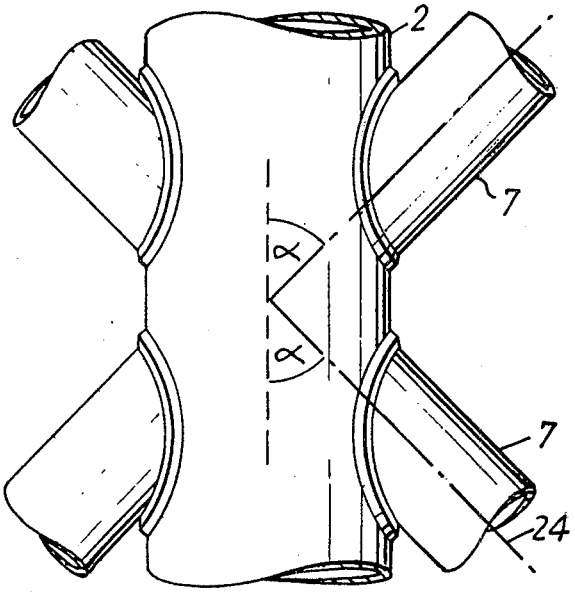
Figure 3:
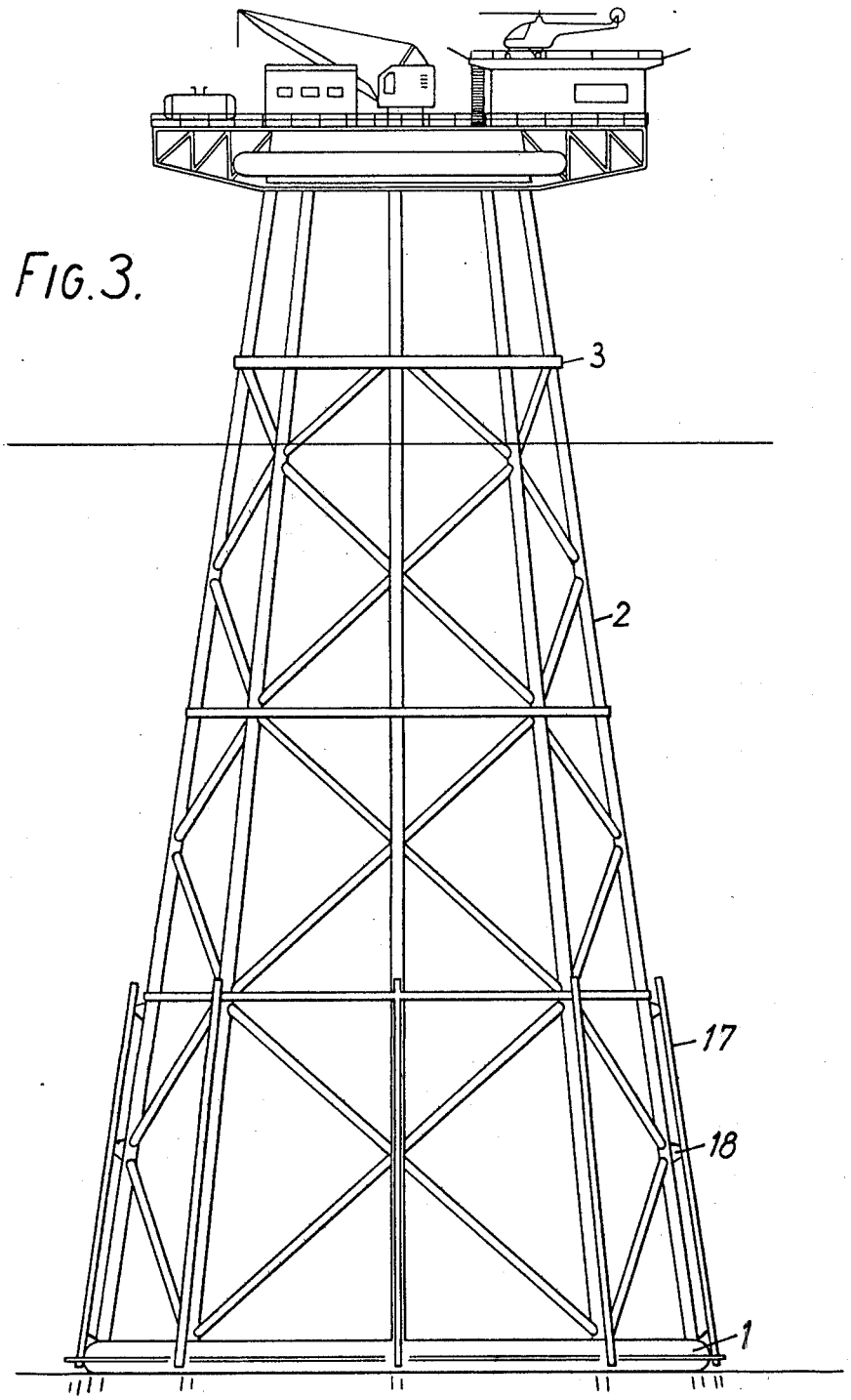
Figure 5A:
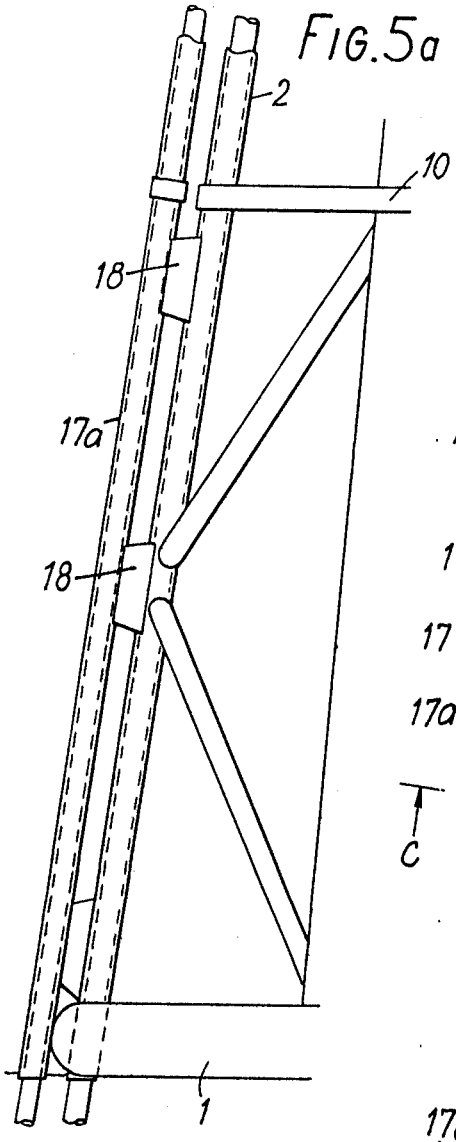
Figure 5B:
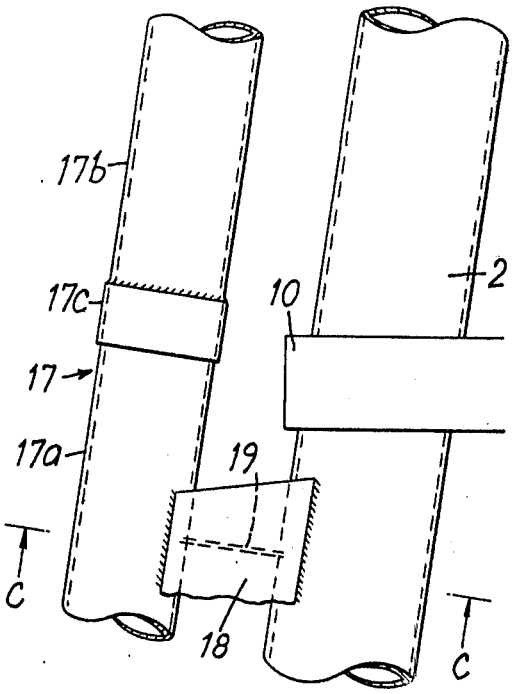
Figure 5C:
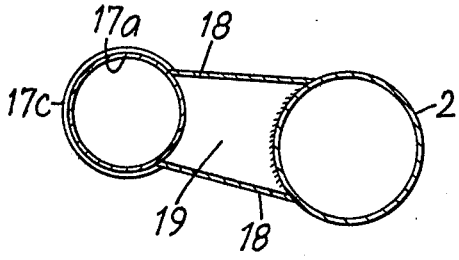
Figure 6A:
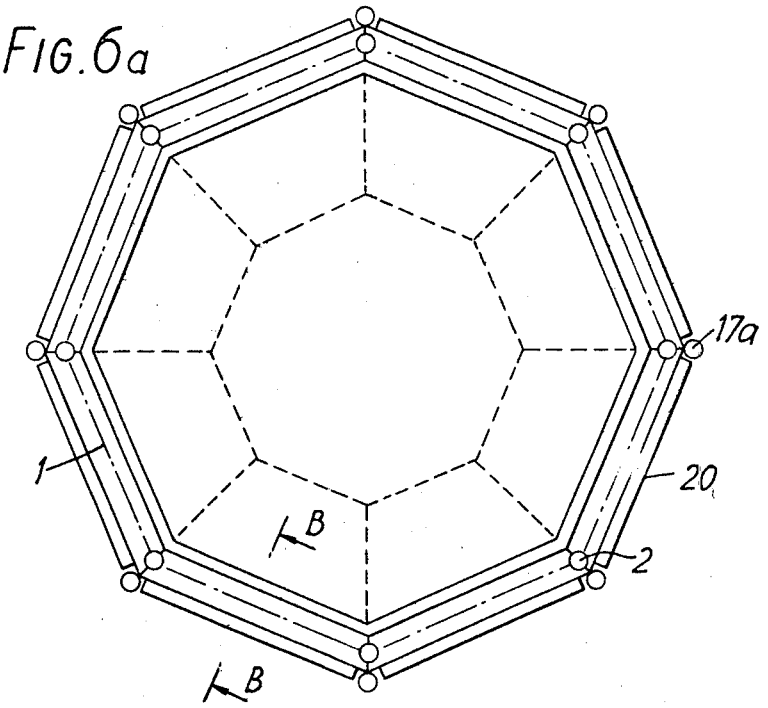
Figure 6B:
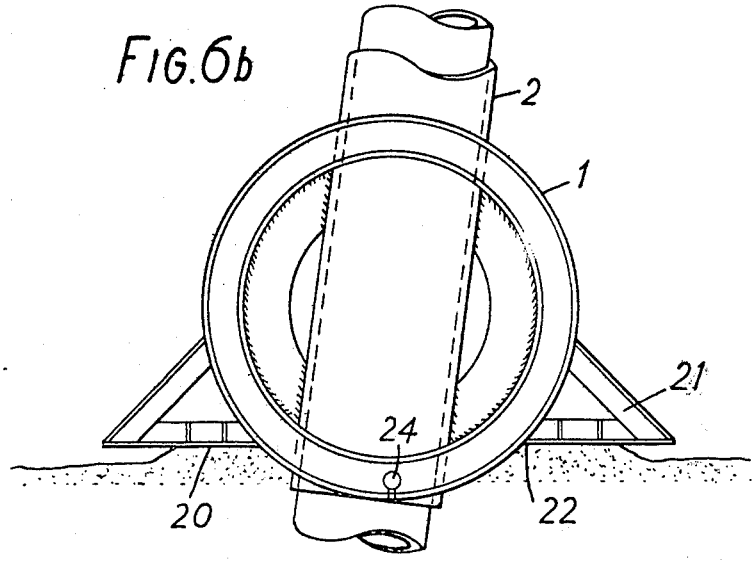
Figure 7A:
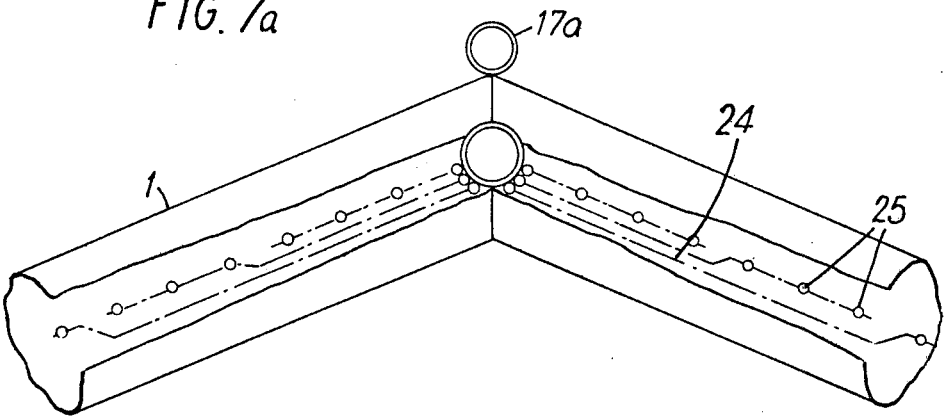
Figure 7B:
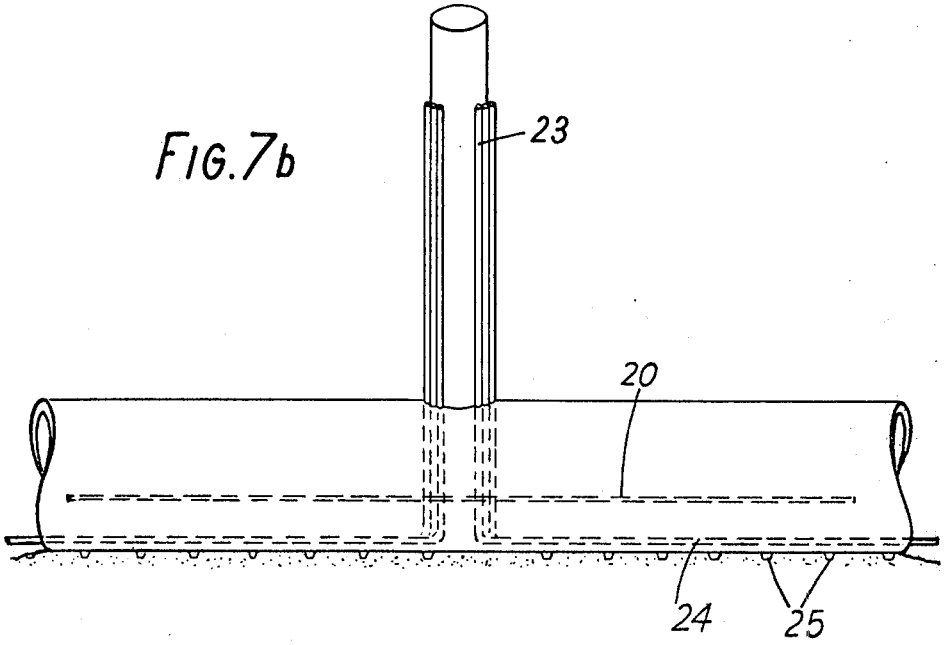
Figure 8:
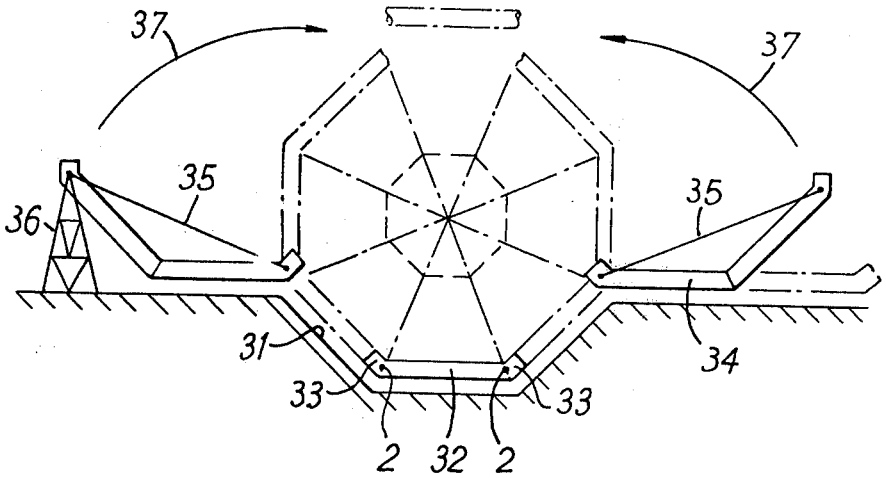
Figure 9:
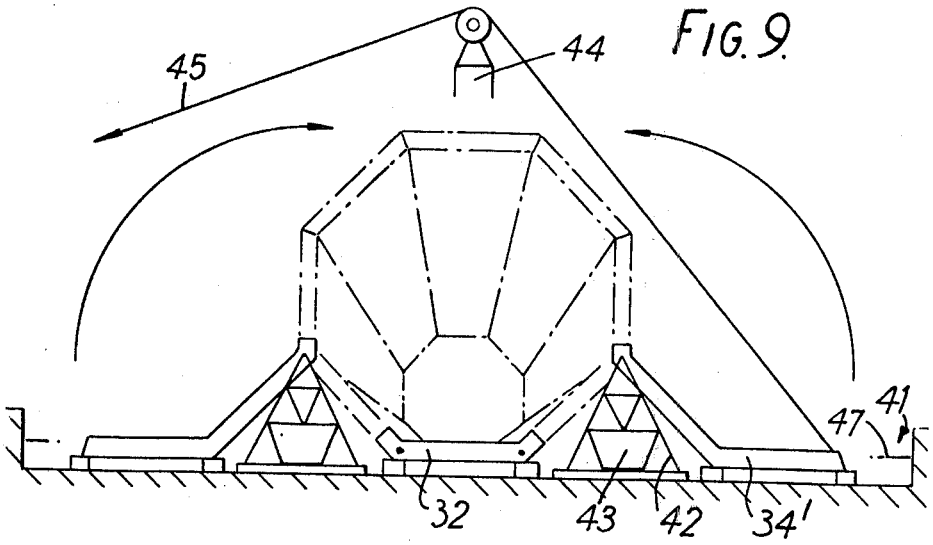
Figure 10:
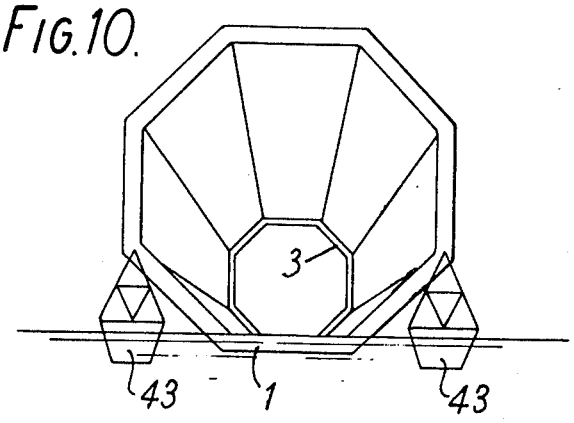
Figure 11:
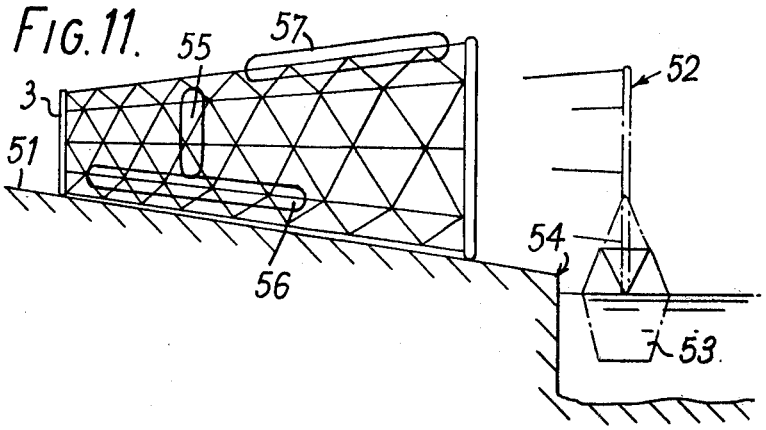
Figure 12:
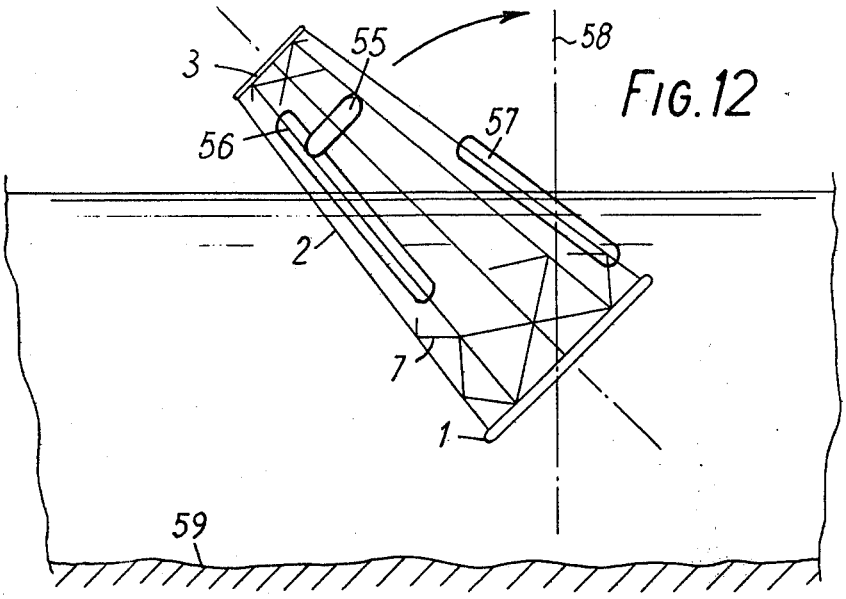
Figure 13:
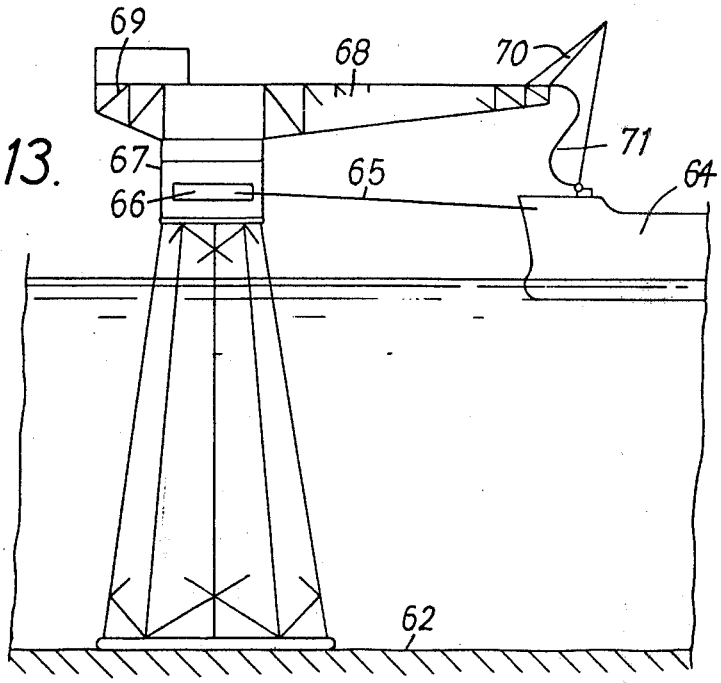
Figure 14A:
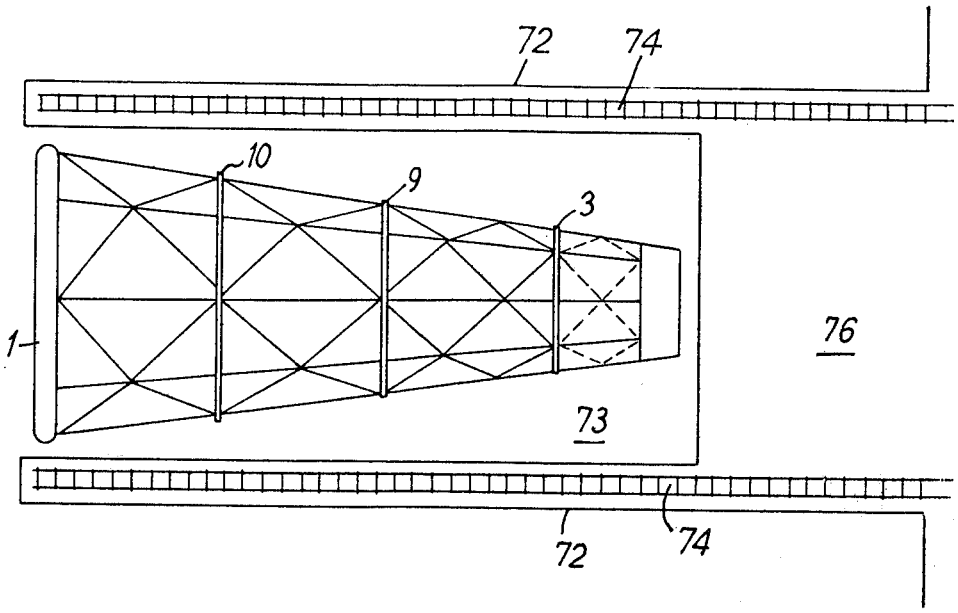
Figure 14B:
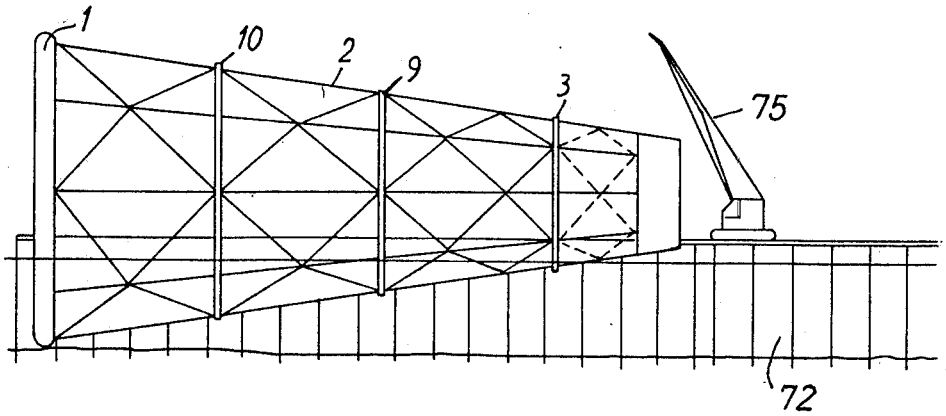
Figure 15:
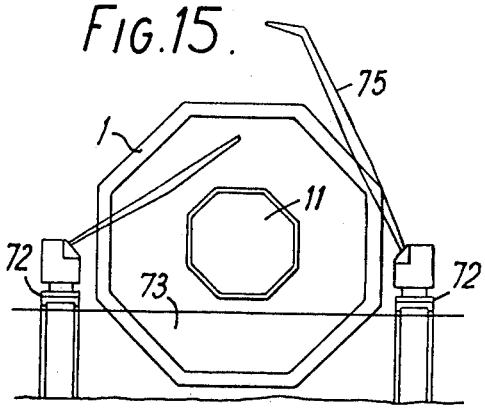
Figure 17:
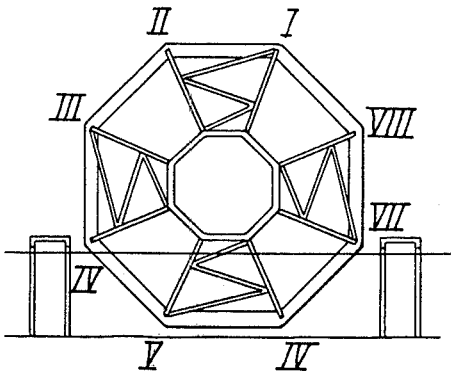
Figure 16:
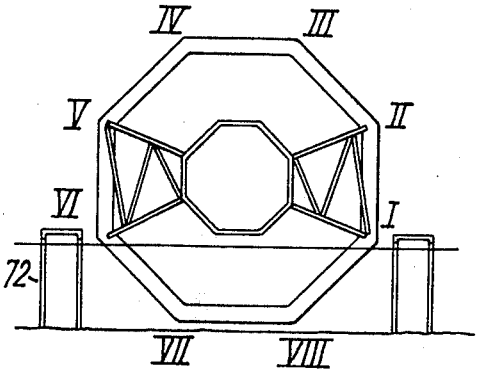
Figure 18:
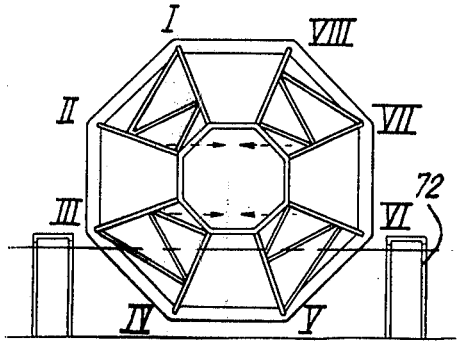
Figure 22:
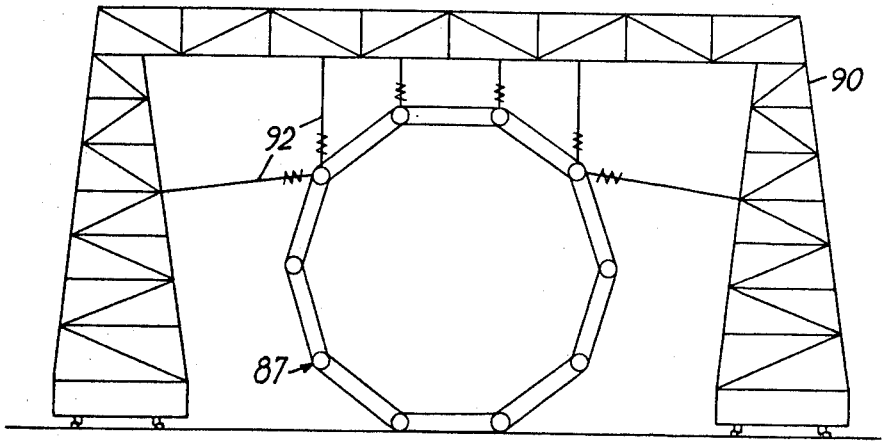
Figure 23:
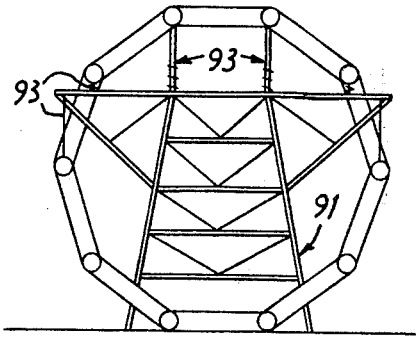
Figure 24:
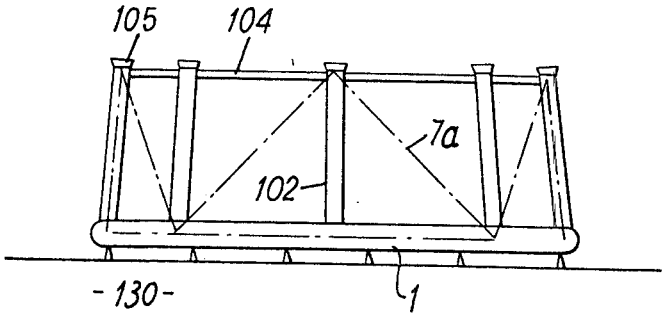
Figure 25:
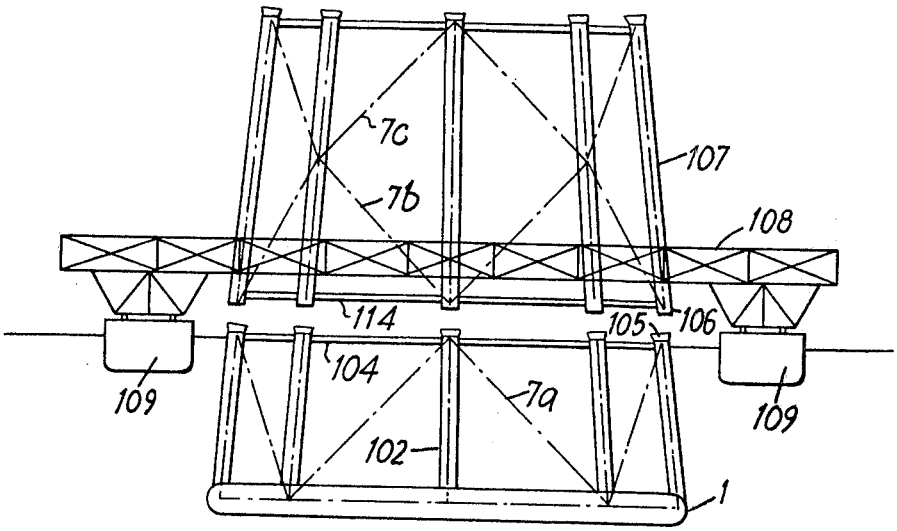

Embodiments of the invention will now be described by way of example, with reference to the accompanying drawings, in which:

FIG. 1 is a side elevation of an octagonal tower structure on the sea bed supporting a production platform over an offshore oil or gas well, FIG. 2 is a plan view of the tower structure shown in FIG. 1, FIG. 3 shows a tower structure whose columns extend continuously to a top deck, FIG. 4 shows a junction between two tubular braces and a column of the structure, on an enlarged scale, FIG. 5*a* shows an auxiliary pile and sleeve in side elevation, FIG. 5*b* shows a detail of FIG. 5*a* on an enlarged scale, FIG. 5*c* is a section on the line C—C of FIG. 5*b*, FIGS. 6*a* and 6*b* show a wing assembly on the base member in plan and cross section respectively, FIGS. 7*a* and 7*b* show a jetting arrangement under the base member in plan and elevation respectively, FIG. 8 shows, in end elevation, one method of assembling the tower structure shown in FIGS. 1 and 2, FIG. 9 is a view similar to FIG. 8, showing an alternative method, FIG. 10 shows, also in end view, the structure as shown in FIG. 8 or 9 being moved to deeper water, FIG. 11 shows in side elevation an alternative method of launching the tower structure, FIG. 12 shows the tower structure being righted into position over its intended site, FIG. 13 shows a tower structure in use as an off-shore mooring, FIGS. 14*a* and 14*b* show respectively in plan and side elevation a fabrication yard and piers after fabrication of a tower structure by a partial floating method, FIG. 15 shows the base member and top frame of the structure of FIGS. 14*a* and 14*b* in water in upright position before placing of columns and bracing members, FIG. 16 shows two prefabricated panels comprising columns and bracing members, placed into position between the base member and the top frame, FIG. 17 shows the structure rotated through 90 degrees and two more panels placed in position, FIG. 18 shows tensioning of panels to eliminate deflections, FIG. 19 shows the placing of bracing members between panels, FIG. 20 shows the structure rotated through 90 degrees with tension applied to bring panel points to right relative positions for adding the remaining bracing members, FIG. 21 shows in side elevation one stage in an alternative method of constructing a tower structure on its side on a slip way, FIGS. 22 and 23 show in end elevation two arrangements for supporting a component of the tower shown under construction in FIG. 21, and FIGS. 24 and 25 show in elevation two stages in a method of constructing a tower structure in upright position.

The tower structure shown in FIGS. 1, 2 and 3 has a base member 1 in the shape of a regular octagon formed from eight lengths of tubing which is preferably of circular cross-section to withstand the hydrostatic pressure. The interior of each length of the base member forms a separate buoyancy chamber the ends of which may be closed by diaphragms (not shown).

Eight tubular columns 2 of equal length extend upwards from the base member, one column 2 being welded to each apex of the base member. The columns 2 are inclined inwardly and upwardly and are welded at their upper ends to respective apices of an octagonal member 3 fabricated from tubing and defining the periphery of a top frame 4 for the tower. The top frame 4 which may be a braced frame or a right ring, is braced by four tubular bracing members 5, forming a square, and a fifth bracing member 6 forming a diagonal for the square and a diameter of the octagonal member 3. The top frame 4 is thus triangularly braced, that is divided into triangles.

Each pair of adjacent columns 2 are interconnected by tubular bracing members 7*a* to 7*m* welded at each end to the column 2 at junctions 8*a* to 8*g* and 8*h* to 8*n* respectively. Thus the bracing members 7 between any pair of columns 2 are arranged in a zig-zag pattern and none of them is either horizontal or intersects or crosses any other bracing member 7.

If it is considered that some additional stiffening is necessary, this may be in the form of horizontal octagonal lattice frames as shown at 9 and 10 in FIG. 1 or rigid box type or tubular rings or bracing members.

As shown in FIG. 1, the tower structure carries a superstructure 11 comprising eight braced upright tubes 12 secured at their lower ends to the apices of the frame 3 of the tower structure and carrying at their upper ends a wellhead production platform 14 with crew quarters 15 and a helicopter pad 16. However, in certain instances, the tower columns 2 may be extended all the way up to the top deck where they are tied together by the deck support trusses as shown in FIG. 3.

FIG. 4 shows one side of a junction 8 in greater detail. Since it is possible to arrange that all the bracing tubes 7 have the same inclination, the angles at which they meet the columns can be standardised at a common angle and thus a standard profile for the ends of the bracing tubes 7 can be established despite their different lengths.

Since all the junctions 8 (FIG. 4) are of effectively identical construction, the behaviour of the structure can be predicted by carrying out tests on one junction in a test rig.

Lower parts 17*a* of auxiliary piling sleeves 17 can be connected to the columns 2 by means of bracket plates 18 as shown in FIGS. 3 and 5. The pair of bracket plates at each connecting point are stiffened laterally by means of stiffener plates 19 which are fitted tightly against the brackets. In the event the auxiliary piles must be removed, the bracket plates are burned off in order to detach them completely from the columns. The sleeves 17 each consist of the fixed lower part 17*a* and a removable upper part 17*b* the lower end of which carries a collar 17*c* which fits over the upper end of the lower sleeve part 17*a*. The upper sleeve part extends upwards above the surface of the water and is detachably secured to the adjacent column 2.

The structures may be placed on sand without the aid of piles if the sand offers sufficient support. It is imperative that scour be prevented. For this reason wings 20 are attached to base 1 on each side of each section and the wings 20 are supported by brackets 21 spaced at intervals. The scour is prevented by the change of streamlines of flow and to aid this, a space 22 may be left at the junction of the wings 20 and the base 1.

In the event that the structure must rest on sand without the aid of piles, the bottom sand must be level. To achieve this, water jets may be used. High pressure lines 23 leading from a pump placed on deck enter the base member 1 and extend on the bottom 24 where they are connected to nozzles 25 at the bottom of the base. The flow from these nozzles moves the sand outward enabling the base to settle evenly into the bed.

To ensure stability, the base member 1 may then be filled with a heavy material such as concrete. Thus, it may not be necessary to adopt the normal practice of anchoring the structure by driving piles.

FIG. 8 shows diagrammatically a method of assembling the tower structure on its side in a temporary excavation 31. The columns 2, bracing tubes 7 and portions of the base member are assembled into prefabricated panels as shown. The lowermost panel 32 comprises two adjacent colunns 2 with their interconnecting bracing and stud portions 33 of the base member (and corresponding stud portions of the top member 3). Two further panels 34 each consist of three of the columns 2 with their interconnecting bracing tubes 7 and two sides of the base member 1 and top member 3 together with further stud portions similar to the portions 33. The panels 34 are held in shape by temporary braces 35. One column 2 of each panel 34 is positioned in its correct position relative to the bottom panel 32 while the outer side of each panel 34 is temporarily supported at 36. The panels 34 are then swung upwards as shown by the arrows 37 into their final positions relative to the bottom panel 32. The remaining portions of the base and top members together with the remaining bracing members 7 are then welded to the panels 32 and 34 to form the complete structure.

FIG. 9 shows a similar method being carried out in a graving dock 41, the inner edges of the panels 34' being mounted for rotation on supports 42 which include buoyant pontoons 43. The panels 34' are swung up into position by temporary lifting masts 44 over which pass cables 45 leading to a winch (not shown).

When assembly has been completed the graving dock 41 may be flooded up to the level shown at 47 and the structure can then be floated out as shown in FIG. 10 as a result of the combined buoyancy of the pontoons 43 and immersed portions of the base member 1, top member 3 and bracing members 7.

In FIG. 11 the tower structure has been assembled, again on its side, on a slip way 51. It is then winched down the slip way 51 to the position shown at 52 in broken lines where its weight is partly taken by pontoons 53 applied to the base member 1. The pontoons 53 are then moved outwards into the water (to the right in FIG. 11) without further winching of the tower structure down the slip way until the top member 3 reaches the lower end 54 of the slip way. Further pontoons (not shown) can then be brought up to support the top end of the tower structure which can then be towed out in substantially the same manner as shown in FIG. 10.

The support structure is towed out to its intended position of use. The pontoons (for example 53) supporting and/or steadying its base member 1 are then removed and the base member 1 is flooded at a controlled rate so that the base member 1 begins to sink and to right the support structure, as shown in FIG. 12, until its axis assumes the vertical position 58. Further controlled flooding of the base member 1 then causes the support structure to settle on the sea bed 59.

The positioning of the tower structure in the water may be further facilitated by means of two buoyancy tanks 56 placed on either side of the tower so as to be at water level during towing and one balance tank 57 placed so as to be above the water level during towing. The buoyancy tanks 56 prevent the tower structure from rotating about its axis while the balance tank 57 produces a restraining force to counteract the angular momentum due to the rotation of the structure about a horizontal axis during righting. It may also be necessary to replace the buoyancy tanks 56 and the balance tank 57 by a horizontlly placed buoyancy tank 55; or the horizontal tank 55 may be placed in addition to tanks 56 and 57.

By filling these tanks gradually the tower structure is lowered to the bottom. Once the tower structure is on the bottom, the tanks may be released from the tower structure. This may be accomplished either by using explosive bolts for connection or by sending down divers to unfasten the connection.

In the embodiment shown in FIG. 13, advantage is taken of the stability of the tower structure to form a combined mooring and offshore terminal for tankers 64 which may be moored by lines 65 to energy-absorbing devices 66 mounted on the tower structure and permitting the tanker 64 to ride under wave action relative to the tower structure. The superstructure 67 on the tower structure carries a rotatable arm 68 which is counterweighted at 69 and carries a crane 70 at its free end for handling connecting hoses 71 for conveying oil to or from the tanker 64 through the tower structure and an underwater pipeline 62.

The tower structure can also be fabricated in the following simple manner. The ease of fabrication, as is described below, is due to the presence of two elements that form the two ends of the structure, namely, the base member and the top frame member. Because of the great buoyancy of these elements the structure may be fabricated in a floating position at sea level thus avoiding the need for very heavy cranes.

The following steps are then taken in order to fabricate an octagonal structure:

1. Two piers and a berthing area 73 in between, large enough to contain the structure, are provided (FIGS. 14*a* and 14*b*). The piers 72 carry tracks 74 which are placed for travelling cranes 75 and for trucks mounted on rails to transport component parts of the tower structure. The piers are situated next to a yard 76 where parts of the tower structure are fabricated.

2. The base member 1 and the top frame 3 are assembled as octagonal buoyant rings and four panels each comprising a pair of adjacent columns and their interconnecting bracing are completely fabricated in the yard 76.

3. The base member 1 and the top frame 3 are floated to position and held upright, the base member being partially flooded, FIG. 15.

4. Two of the prefabricated panels are brought up on the tracks and mounted between points I, II and V, VI on the base member and the top frame, FIG. 16.

5. The floating structure with the two panels now mounted, is rotated through 90°.

6. The other two prefabricated panels are brought up and mounted between points VII, VIII and III, IV, FIG. 17.

7. The structure is rotated 45° to the position shown in FIG. 18, in order to fill in the bracing members between the points VI, VII and II, III near sea level.

8. The columns corresponding to the points VI and III and similarly VII and II, are pulled towards each other by tension cables at intervals along the columns to bring them to their correct relative positions. The bracing members are then mounted, FIG. 19.

9. The structure is rotated through 90°. Tension cables are applied at intervals along columns IV and I, and similarly along columns V and VIII to bring them to their exact relative positions. The bracing members are then placed and welded (FIG. 20), thus finishing the fabrication. Temporary spacers may be placed between the adjacent columns during fabrication.

When constructing a tower structure of the kind shown in FIG. 3, the superstructure platform can be assembled to the ends of the columns which will then extend beyond the top frame 3.

The tower structure thus formed is ready to be towed out to its intended site for use.

FIGS. 21 to 23 show a further alternative method of constructing the tower structure on its side on a slip way. This method is particularly appropriate where the tower structure is to have horizontal bracing members such as 9 and 10. The tower structure shown under construction differs from that shown in FIG. 3 in that it is decagonal instead of octagonal.

At the stage of construction shown in FIG. 21, the central portion 81 of the superstructure has been prefabricated and supported in position corresponding to the lowermost columns 2 being horizontal. The top frame member 83 has been prefabricated to include column extension portions 82 and have been lifted into position and the column extensions 82 have been welded to corresponding stub portions 84 on the superstructure portion 81. The prefabricated top frame assembly 83 also includes stubs 85 and 86 in the form of portions of the columns 2 and bracing members 7.

Next, a prefabricated assembly 87 consisting of a ring formed by the horizontal bracing members 9 for example and including further stub portions 88 and 89 is lifted into position and supported for example by an overhead travelling gantry 90, such as is shown in FIG. 22 or by a temporary support frame 91 such as is shown in FIG. 23. To ensure that the stubs 88 are properly aligned with the stubs 85, tension or jacking forces can be applied to the ring 87, for example, in the positions shown at 92 in FIG. 22 or 93 in FIG. 23.

Thereafter column elements 94 and nodal point assemblies 95, the latter comprising column elements and portions of the bracing member 7, are lited into position between the assembly 87 and the top frame 85 and are welded in place.

Construction of the tower structure then proceeds, further ring assemblies being assembled to the structure in the same manner as the ring assembly 87. Finally, the base member 1 is assembled to the structure.

In the construction method illustrated in FIGS. 24 and 25, the base member 1 and the lowermost portions 102 of the columns are constructed and assembled on a slip way 103, together with the lowermost bracing members *7a.* When horizontal bracing members such as 9 and 10 are to be employed, the lower portions of these in the form of channel members 104 with open sides facing upwards may be welded to the upper ends of the column portions 102.

Also welded to the uppermost ends of the column portions 102 are hollow frusto-conical guides 105 for the lower ends of the column portions 106 of the next portion 107 (FIG. 25) of the tower structure which has been prefabricated at the same time as the base member 1.

To assemble the two portions of the tower structure thus formed together, the base member 1 is launched and towed into sufficiently deep and sheltered water to enable it to be lowered in the water by controlled flooding of the base member 1 until the guides 105 re just above the level of the water as shown in FIG. 25. The section 107 of the tower structure is then manoeuvred into position above the base member section. For this purpose, the section 107 may be supported by means of trusses 108 into connecting barges 109 as shown in FIG. 25 or other lifting means may be used such as floating cranes or sheer legs mounted on barges. The section 107 is then slowly lowered, for example by controlled flooding of the barges 109, until the lower ends of its column portions 106 are received in the guides 105. The two tower sections are then permanently connected together by welding the column sections together, the guides 105 being cut-away if desired. The tower section 107 includes downwardly open channel members 114 which form the upper edges of the horizontal bracing members 10 and which are either welded directly to the members 104 or connected to them by plates welded to the edges of the channel members 104 and 114.

The assembly thus formed is then lowered further into the water until guides 105 at the upper end of the section 107 are just above the water line. Further sections can then be added sequentially in the same manner as the section 107. Finally the top frame and the superstructure are added.

The tower structures described above require up to 35% less steel, for a given load carrying capacity, than equivalent conventional offshore production platform structures.

If desired, the columns can be further stiffened by inserting reinforcing bars and concrete into them when the tower structure is in position on its intended site, after any piles have been driven through them.

We claim:

1. A tower structure adapted to be supported on a bed beneath a body of water with the upper end of the tower structure above the surface of the water, said tower structure comprising a rigid top frame, an even number greater than four of straight tubular columns, an annular polygonal base support member for resting on said bed having the same number of sides as the number of said tubular columns, said columns sloping downwardly and outwardly from said top frame to said base member, said columns being secured at their lower ends to respective apexes of said base member and at their upper ends to said top frame and having a length predetermined to extend adjacent or above the surface of the water, and an even number of similar sets of coplanar tubular bracing members respectively interconnecting each pair of adjacent columns, the bracing members of each set being arranged in a zig-zag pattern without intersecting each other but with adjacent ends of adjacent bracing members of each set secured to the respective column of the pair at the same anchor point, with the axes of said bracing members substantially intersecting the axis of said respective column at each said anchor point, not more than two bracing members of each set meeting a column at any anchor point, one such bracing member being inclined above the horizontal and the other below the horizontal, the anchor points on each column for the two sets of bracing members connected to the column being in register.

2. A tower structure according to claim 1, in which the base member is constructed to form one or more floodable buoyancy chambers.

3. A tower structure according to claim 1, in which at each junction of bracing members with a column, two and only two bracing members in the same plane to the column intersect that column in the position of the junction, one of the two bracing members being inclined above the horizontal while the other is inclined below the horizontal.

4. A tower structure according to claim 1, in which the bracing members have the same acute angle of inclination to the columns.

5. A tower structure according to claim 1 having a superstructure platform mounted above the top frame.

6. A tower structure according to claim 5, in which the columns are hollow and are extended along straight lines above the top frame into the superstructure platform.

7. A tower structure according to claim 1 in which the base member includes wing means for increasing the effective horizontal area of the base member.

8. A tower structure according to claim 7, in which the wing means form spoiler means for reducing scouring of the supporting bed.

* * * * *